US008366513B2

(12) United States Patent
Demmler et al.

(10) Patent No.: US 8,366,513 B2
(45) Date of Patent: Feb. 5, 2013

(54) APPARATUS AND METHOD FOR THE PROTOTYPE AND SMALL-BATCH PRODUCTION OF GEAR WHEELS

(75) Inventors: Willi Demmler, Dettingen (DE); Manfred Zankl, Oberguensburg (DE)

(73) Assignee: Liebherr-Verzahntechnik GmbH, Kempten (DE)

( * ) Notice: Subject to any disclaimer, the term of this patent is extended or adjusted under 35 U.S.C. 154(b) by 316 days.

(21) Appl. No.: 12/378,916

(22) Filed: Feb. 20, 2009

(65) Prior Publication Data

US 2009/0233526 A1 Sep. 17, 2009

(30) Foreign Application Priority Data

Feb. 21, 2008 (DE) ..... 10 2008 010 302

(51) Int. Cl.
*B24B 53/00* (2006.01)

(52) U.S. Cl. ..... 451/11; 451/47; 451/443

(58) Field of Classification Search ..... 451/11, 451/5, 541, 47, 443, 444, 56, 72
See application file for complete search history.

(56) References Cited

U.S. PATENT DOCUMENTS

| | | | |
|---|---|---|---|
| 4,142,333 | A | 3/1979 | Fivian |
| 6,491,568 | B1 | 12/2002 | Jankowski |

FOREIGN PATENT DOCUMENTS

| | | |
|---|---|---|
| DE | 2641554 | 3/1978 |
| DE | 4302353 | 8/1993 |
| DE | 19624842 | 1/1998 |
| DE | 19706867 | 8/1998 |
| DE | 19901338 | 3/2000 |
| EP | 0328482 | 8/1989 |
| EP | 0993908 | 4/2000 |
| EP | 1361012 | 11/2003 |

*Primary Examiner* — Robert Rose
(74) *Attorney, Agent, or Firm* — Dilworth & Barrese, LLP.

(57) ABSTRACT

This invention relates to an apparatus for the prototype and small-batch production of gear wheels with a dressing disk. In accordance with the invention, the dressing disk has an asymmetric flank shape and a defined head radius. Furthermore, this invention relates to a method for the prototype and small-batch production of gear wheels by using such dressing disk.

14 Claims, 1 Drawing Sheet

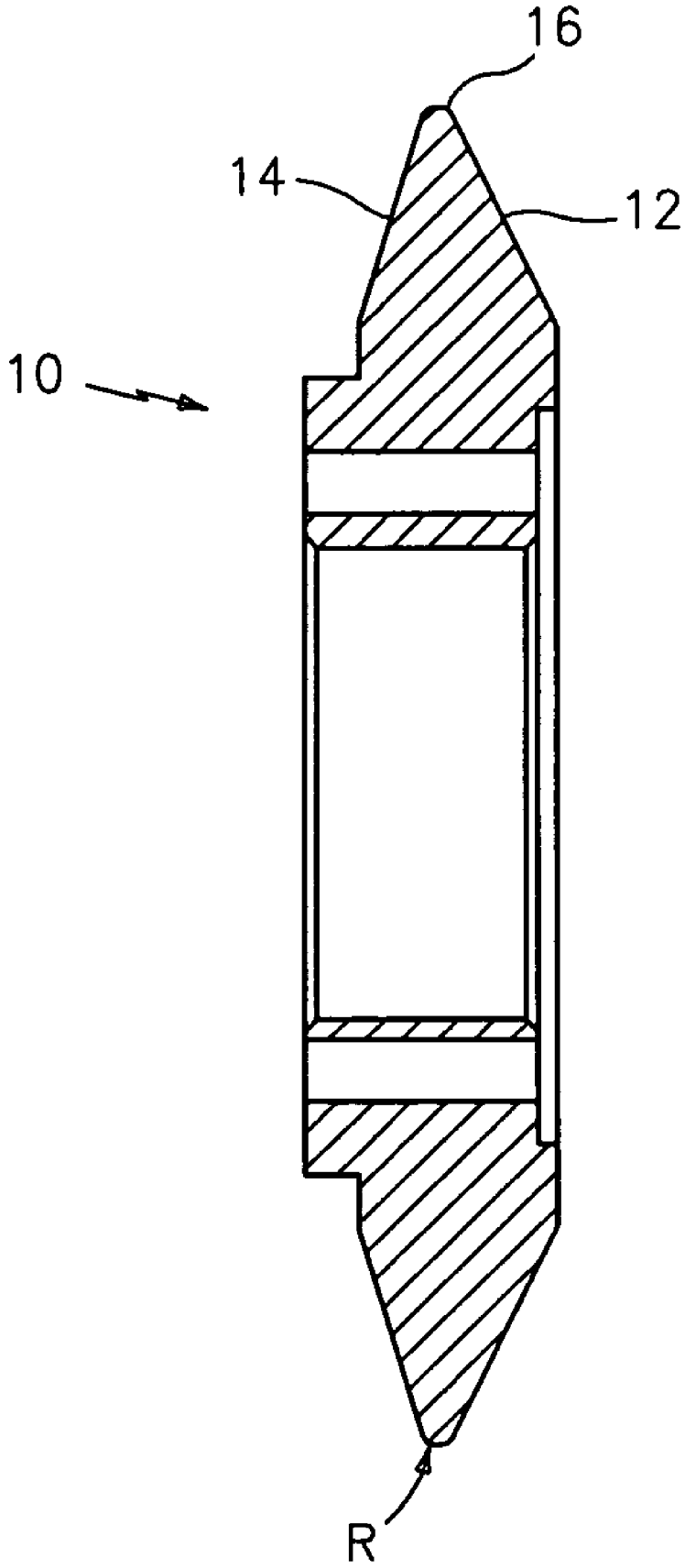
16
14
12
10
R

APPARATUS AND METHOD FOR THE PROTOTYPE AND SMALL-BATCH PRODUCTION OF GEAR WHEELS

BACKGROUND OF THE INVENTION

This invention relates to an apparatus and a method for the prototype and small-batch production of gear wheels.

In the production of gear wheels, prototype or small-batch production recently has increasingly gained importance. When making very expensive and large workpieces, it should rather be prevented that the first workpiece fabricated as prototype must be discarded as reject. In particular the requirement of very short manufacturing times calls for a novel, very flexible and fast manufacturing process.

The previous procedure for the production of prototypes can be divided into the following method steps:

1. First design of the gear teeth regarding the selection of the profile and flank correction, the quality to be chosen, etc.;
2. determining the production process and the finishing method;
3. manufacturing the blank by turning, drilling, etc.;
4. pre-cutting gear teeth for instance by hobbing, shaping, generation grinding or profile grinding;
5. hardening or heat-treating;
6. optionally hard finishing by generation or profile grinding;
7. test operation with the prototype gear wheels on a test stand or in a real transmission; and
8. improved new design or first start of pilot production.

In the aforementioned procedure, upon determining the profile in method step 3, the tool is designed for pre-cutting gear teeth and for hard finishing and is commissioned. The manufacturing and delivery time for these tools is very long and can be up to three months. Possibly desired changes or manufacturing defects on the tool will only become visible during first use thereof, and therefore inevitably lead to the necessary remachining, for instance the decoating, regrinding or recoating of a hob. This involves a loss of production of several days or weeks.

As far as in steps 3 and 6 of the aforementioned method pre-cutting gear teeth and hard finishing should be effected by generation grinding, a galvanically coated dressing tool is required for this generation grinding, which has the special profile shape of the gear teeth. The manufacture of such dressing tool also requires a delivery time of several weeks. As a universally applicable alternative for a profile-adapted dressing tool, a universal dressing tool can also be used, with which the grinding worm is dressed line by line. Here, the special profile shape thus is produced by the control of the grinding or dressing machine. In this method, there is no delivery time for the special tool. However, it is disadvantageous that dressing the grinding worm from the cylindrical blank takes several hours. If corrections in the tooth profile, for instance with regard to the profile angle, tip relief or depth crown, are necessary after generation grinding of the first workpiece, a lengthy line-by-line dressing cycle must be restarted when using a universal dressing tool. Depending on the extent of the correction to be made, such cycle can be very long. In the case of a specially designed profile dresser, however, an even greater production delay is obtained, which can be several weeks, as this dressing tool must be sent back to the tool supplier for correction.

The steps of pre-cutting gear teeth and hard finishing by profile grinding corresponding to method steps 3 and 6 of the aforementioned procedure also can be performed by means of a profile grinding method. When dressing, the inverse profile is applied onto the grinding element and then is transferred onto the workpiece during grinding, wherein a simple kind of movement, such as a very slow linear movement while rotating the grinding element, mostly is sufficient. As compared to the aforementioned generation grinding method, this involves a disadvantage with regard to the machining time, since the profile grinding method is distinctly slower. In particular in the case of great tooth widths and high tooth numbers, distinctly higher grinding times are required. If profile grinding is used for pre-cutting gear teeth, the complete tooth height must be formed. This is referred to as grinding into solid block, in which the machining time again is distinctly longer than in the case of generation grinding.

SUMMARY OF THE INVENTION

It is the object of the invention to distinctly reduce the manufacturing time of prototypes or small batches with a minimum of tool costs. This should allow the machining of untoothed or pretoothed and possibly hardened gear wheels. Furthermore, this method should be universally applicable, because all gear teeth can be produced with one grinding and one dressing tool with any profile modifications.

In accordance with the invention, this object initially is solved by an apparatus with the features of herein.

Accordingly, there is provided an apparatus for the prototype and small-batch production of gear wheels, which includes a disk-shaped dressing tool which on the one hand has an asymmetric flank shape and a defined head radius in accordance with a preferred embodiment. The dressing tool has the same or a different flank angle on its right and left cone flanks and a defined head radius. With this dressing tool, both grinding worms and profile grinding disks can be dressed. This universally applicable dressing tool can be used independent of the modulus and pressure angle of the respective gear teeth. All profile modifications in the grinding tool can be realized here. In grinding worms, for instance, different numbers of threads can be produced from a cylindrical blank. Ordering preprofiled grinding worms, which—as explained above—have a longer delivery time, hence can completely be omitted.

In the already known manufacturing method for prototypes, the user also has tried already to completely eliminate the undesired delivery times of grinding worms. However, in the production of prototypes by means of the generation grinding method, a stock of different pre-profiled grinding worms had to be created, in order to be able to flexibly react to the specified toothing data. Due to the variety of combinations of pressure angle, modulus and number of threads, a very large number of grinding worms was obtained when creating a corresponding stock, which has resulted in a high burden of costs. With the apparatus in accordance with the invention it now is possible that only few—for instance two to three—cylindrical blanks are put in stock, which then can flexibly be dressed according to the particular specifications.

Advantageous aspects of the apparatus in accordance with the invention are provided in the description herein.

Accordingly, one flank of the disk-shaped dressing tool can include an angle of 15° to 25°, preferably 20°, whereas the other flank includes an angle of 10° to 14°, preferably 12°.

In accordance with another advantageous aspect of the invention, the head radius can be 0.3 mm to 0.7 mm, preferably 0.5 mm.

Finally, the disk-shaped dressing tool advantageously is reinforced by means of a hard material on its surface.

In accordance with a further advantageous configuration of its surface, the disk-shaped dressing tool can be covered with different grains. On the flanks, for instance, a coarse grain can be chosen on the surface, which can be used for instance for pregrinding when profiling a worm. The region of the radius, on the other hand, is covered with a fine grain. In this way, for instance, a disk can be profiled, and here a high-quality surface can be produced on the disk with corresponding profile corrections.

The apparatus of the invention can be useful for dressing a grinding worm or a grinding disk in a conventional CNC generation and profile grinding machine. Due to the different flank angles over the range of swivel angles of the CNC generation and profile grinding machine in accordance with the invention, a range of pressure angles of several degrees can be achieved, for instance a range of pressure angles $\alpha=12°$ to 25°.

In accordance with the invention, the above-mentioned object is solved by a method for the prototype and small-batch production of gear wheels by using the above-described apparatus with the method steps indicated herein.

In the method, a dressable grinding disk and a dressable grinding worm are used in a manner known per se. Both the grinding disk and the grinding worm are mounted on a tool arbor. In the prototype or small-batch production of gear wheels, the grinding worm is used for what is called roughing, which provides for a high removal rate and hence a shorter machining time. On the other hand, the grinding disk mounted on the tool arbor is used for smoothing, whereby a good surface quality of the gear wheel prototype is achieved and all profile modifications can be produced.

Corresponding to the procedure in accordance with the invention, the grinding worm arranged on the tool arbor first is preprofiled by means of the disk-shaped dressing tool and subsequently finish-profiled. Furthermore, the grinding disk arranged on a tool arbor together with the grinding worm is profiled with the disk-shaped dressing tool, wherein the profile grinding disk can be profiled freely and flexibly by the CNC control of the CNC generation and profile grinding machine, whereby a very high profile quality is achieved.

In accordance with a particular aspect of the method, the pre-profile can be punched out of a cylindrical worm blank or a disk blank by means of a so-called sacrificial disk. Sacrificial disk here is understood to be a tool which is used for the quick and coarse removal of material and can be discarded after a corresponding pre-profiling step.

By means of the disk-shaped dressing tool described above, it now is possible to profile and sharpen both tools, namely the grinding worm and the grinding disk, without changing the dressing tool.

With the correspondingly profiled grinding worm or grinding disk, the gear teeth of the gear wheel to be manufactured can be ground by means of a combination of generation and profile grinding.

BRIEF DESCRIPTION OF THE DRAWINGS

Further features, details and advantages of the invention will be explained in detail with reference to an embodiment illustrated in the drawing.

DESCRIPTION OF THE PREFERRED EMBODIMENTS

The only FIGURE shows a disk-shaped dressing tool in a configuration of a preferred embodiment of the present invention.

In the only FIGURE, a disk-shaped dressing tool is shown, which can be mounted in a non-illustrated CNC generation and profile grinding machine and can be driven by the same.

As can be taken from the FIGURE, the disk-shaped dressing tool 10 has two inclined flanks 12 and 14, which converge in a head region 16.

The flank 12, which is located on the bolting side of the disk-shaped dressing tool 10, includes an angle of 20°, whereas the opposite flank includes an angle of 12°. The head region 16 has a defined head radius R=0.5 mm.

In the vicinity of the flanks and the head radius, the disk-shaped dressing tool is reinforced by means of a hard material. This reinforcement of hard material can for instance be a so-called PCD reinforcement, i.e. a reinforcement with hand-set synthetic diamonds. By using the above-described dressing disk on a CNC generation and profile grinding machine known per se, for instance of the LCS series of the firm Liebherr, the following method for the prototype and small-batch production of gear wheels can be realized, which can be divided into the following method steps:

1. Setting up the machine by fitting the tools, balancing the tools, etc.;
2. input of the machining parameters, gear tooth and tool data;
3. pre-profiling the grinding worm for instance from a cylindrical solid grinding element by means of the above-described disk-shaped dressing tool;
4. finish-profiling the grinding worm by means of the above-described disk-shaped dressing tool;
5. profiling the grinding disk by means of the aforementioned disk-shaped dressing tool;
6. grinding the gear teeth by means of combined generation and profile grinding by using the previously profiled grinding worm and grinding disk;
7. measuring the gear teeth; and
8. profile grinding to size, and when the measured gear teeth correspond with the specified data, the same machine setting data that were entered can be employed corresponding to the measurement result, or for the case that the gear teeth do not correspond with the specified data, a correction can be made by adjusting the CNC generation and profile grinding machines or by redressing the tools by means of the universally applicable disk-shaped dressing tool.

The invention claimed is:

1. An apparatus for the prototype and small-batch production of gear wheels with a disk-shaped dressing tool (10), wherein the disk-shaped dressing tool (10) has an asymmetric flank shape and a defined head (16) radius, with straight right (12) and left (14) cone flanks continuously tapering at different angles both from one another and tangential a radius of the dressing tool (10), such that both a grinding worm and grinding disk can be sharpened or profiled by the same dressing tool (10) without changing the dressing tool (10).

2. The apparatus according to claim 1, wherein one flank includes an angle of 15° to 25° and the other flank includes an angle of 10° to 14°.

3. The apparatus according to claim 1, wherein the head radius is 0.3 mm to 1.5 mm.

4. The apparatus according to claim 1, wherein the disk-shaped dressing tool is reinforced by a hard material.

5. An apparatus for the prototype and small-batch production of gear wheels with a disk-shaped dressing tool (10), wherein the disk-shaped dressing tool (10) has an asymmetric flank shape and a defined head (16) radius, with straight right (12) and left (14) cone flanks continuously tapering at different angles both from one another and tangential a radius of the dressing tool (10), and the disk-shaped dressing tool is covered with a coarse grain on its flanks and with a fine grain on its radius, such that both a grinding worm and grinding disk can be sharpened or profiled by the same dressing tool (10) without changing the dressing tool (10).

6. A method for the prototype and small-batch production of gear wheels with a disk-shaped dressing tool (10) having an asymmetric flank shape and a defined head (16) radius, and straight right (12) and left (14) cone flanks continuously tapering at different angles both from one another and tangential a radius of the dressing tool (10), comprising the following steps:

pre-profiling a grinding worm, finish-profiling the grinding worm, profiling a grinding disk arranged on a tool arbor together with the grinding worm, grinding the gear teeth of the gear wheel to be manufactured by at least one of generation profile grinding, such that both a grinding worm and grinding disk can be sharpened or profiled by the same dressing tool (10) without changing the dressing tool (10).

7. The method according to claim 6, wherein the pre-profile is punched out of a cylindrical worm blank or disk blank by a sacrificial disk.

8. The method according to claim 6, wherein the method is performed by a control with the aid of a computer.

9. The apparatus according to claim 2, wherein the disk-shaped dressing tool is reinforced by a hard material.

10. The apparatus according to claim 3, wherein the disk-shaped dressing tool is reinforced by a hard material.

11. The apparatus according to claim 2, wherein one flank includes an angle of 20°.

12. The apparatus according to claim 2, wherein the other flank includes an angle of 12°.

13. The apparatus according to claim 2, wherein one flank includes an angle of 20°, and the other flank includes an angle of 12°.

14. The apparatus according to claim 3, wherein the head radius is 0.5 mm.

* * * * *